US011873615B2

(12) United States Patent
Heichel et al.

(10) Patent No.: US 11,873,615 B2
(45) Date of Patent: Jan. 16, 2024

(54) VIBRO REPLACEMENT PROBE AND METHOD FOR EQUIPPING A LEADER WITH A VIBRO REPLACEMENT PROBE

(71) Applicant: ABI Anlagentechnik-Baumaschinen-Industriebedarf Maschinenfabrik und Vertriebsgesellschaft mbH, Niedernberg (DE)

(72) Inventors: Christian Heichel, Niedernberg (DE); Albrecht Kleibl, Grossostheim (DE)

(73) Assignee: ABI ANLAGENTECHNIK-BAUMASCHINEN-INDUSTRIEBEDARF MASCHINENFABRIK UND VERTRIEBSGESELLSCHAFT MBH, Niedernberg (DE)

( * ) Notice: Subject to any disclaimer, the term of this patent is extended or adjusted under 35 U.S.C. 154(b) by 0 days.

(21) Appl. No.: 17/716,008

(22) Filed: Apr. 8, 2022

(65) Prior Publication Data

US 2022/0380995 A1 Dec. 1, 2022

(30) Foreign Application Priority Data

May 31, 2021 (EP) ..... 21176859

(51) Int. Cl.
*E02D 3/08* (2006.01)
*E02D 3/054* (2006.01)
*E02D 7/18* (2006.01)

(52) U.S. Cl.
CPC ..... *E02D 3/08* (2013.01); *E02D 3/054* (2013.01); *E02D 7/18* (2013.01)

(58) Field of Classification Search
CPC ..... E02D 3/08; E02D 3/046; E02D 3/054; E02D 3/068; E02D 3/074; E02D 3/12; E02D 3/123; E02D 7/18
See application file for complete search history.

(56) References Cited

U.S. PATENT DOCUMENTS 3,583,497 A * 6/1971 Kussowski ..... E02D 7/18 74/61
4,280,770 A * 7/1981 Woodruff ..... E02D 3/054 405/271

(Continued)

FOREIGN PATENT DOCUMENTS

CN 112240159 A * 1/2021 ..... E02D 7/22
DE 10 2004 013 790 A1 10/2005

(Continued)

OTHER PUBLICATIONS

European Search Report dated Mar. 14, 2022 in European Application No. 21176859.3 with English translation of the relevant parts.

*Primary Examiner* — Frederick L Lagman
(74) *Attorney, Agent, or Firm* — Collard & Roe, P.C.

(57) ABSTRACT

A vibro replacement probe includes a ramming tube that is connected with a filling piece that includes a feed tube as well as a filling funnel and/or a hose connection flange. The feed tube is firmly connected with a vibrator that has a mechanism for pivoting attachment to the leader of a construction machine, wherein the mechanism includes a connection part that is connected with the vibrator so as to pivot and that can be attached to a carriage that is displaceably guided on the leader. Furthermore, a construction machine has such a vibro replacement probe and a method equips a leader of a construction machine with such a vibro replacement probe.

16 Claims, 8 Drawing Sheets

(56) References Cited

U.S. PATENT DOCUMENTS

| | | | | |
|---|---|---|---|---|
| 5,257,667 | A * | 11/1993 | Sano | E02D 11/00 173/128 |
| 6,588,987 | B1 * | 7/2003 | Degen | E02D 7/14 405/271 |
| 7,713,002 | B2 * | 5/2010 | Stoetzer | E02D 7/16 175/308 |
| 8,079,780 | B2 * | 12/2011 | Wissmann | E02D 5/72 405/240 |
| 10,961,678 | B2 * | 3/2021 | Degen | E02D 3/054 |
| 2004/0258486 | A1 * | 12/2004 | Otsuka | E02D 3/10 405/231 |
| 2011/0243667 | A9 * | 10/2011 | Fox | E02D 5/44 405/239 |
| 2013/0272798 | A1 * | 10/2013 | Paul | E02D 5/665 405/252.1 |
| 2013/0322971 | A1 | 12/2013 | Heichel | |
| 2016/0097177 | A1 * | 4/2016 | Lebreton | E02D 5/30 405/232 |

FOREIGN PATENT DOCUMENTS

| | | | | |
|---|---|---|---|---|
| EP | 2241677 | A2 * | 10/2010 | E02D 3/08 |
| EP | 2 669 436 | A1 | 12/2013 | |
| ES | 2673580 | T3 * | 6/2018 | E02D 3/054 |
| KR | 100622530 | B1 * | 9/2006 | E02D 3/054 |

* cited by examiner

VIBRO REPLACEMENT PROBE AND METHOD FOR EQUIPPING A LEADER WITH A VIBRO REPLACEMENT PROBE

CROSS REFERENCE TO RELATED APPLICATIONS

Applicant claims priority under 35 U.S.C. § 119 of European Application No. 21176859.3 filed May 31, 2021, the disclosure of which is incorporated by reference.

BACKGROUND OF THE INVENTION

1. Field of the Invention

The invention relates to a vibro replacement probe. The invention furthermore relates to a method for equipping a leader of a construction machine with a vibro replacement probe.

2. Description of the Related Art

To increase the bearing capacity of foundation soil, it is known to improve it by means of the method of vibro replacement. This method is particularly used in the case of heaped-up or very soft soils. In this method, what are called vibro stone columns are introduced into the foundation soil. This introduction is done in that the ramming tube of a vibro replacement probe is set onto the foundation soil and introduced by means of a vibrator, whereby the loose soil is displaced sideways. In this regard, the lower opening of the ramming tube is closed, for example by means of a lost lid or an arrangement of multiple chains that interlock as they are rammed in. The tube is filled with suitable added material, such as gravel, slag or railway ballast, and subsequently pulled alternately, whereby material constantly exits on the side of the tube that faces the soil, which is further compacted by means of lowering the tube again multiple times. As a result, a column of the compacted added material is produced in the ground, and this column is referred to as a vibro stone column. To apply material, the vibro replacement probe has a funnel that is connected with the ramming tube.

In modified form, the method has been increasingly establishing itself for the production of on-site concrete piles, often also referred to as on-site concrete driven piles. In this regard, the ramming tube, which is open toward the bottom, is filled with concrete after it has been rammed in, and subsequently pulled out of the ground. Vibro replacement probes for this method are provided with a filler pipe, instead of with a funnel, for filling them with concrete. This filler pipe is arranged at the upper end of the ramming tube.

Vibro replacement must be distinguished from vibro compaction. Vibro compaction is usually carried out using an immersion vibrator. In this regard, an imbalance rotates about a vertical axis in the vibrator tip. The immersion vibrator differs significantly from a vibrator in terms of technology. While a vibrator performs an oscillating vertical linear movement, the immersion vibrator moves on a circular path that lies in a horizontal plane.

To introduce the ramming tube into the ground, the vibro replacement probe is attached to a vibrator guided on a leader. In this regard, great demands are made on the connection between the vibrator and the vibro replacement probe, because great bending torques occur at the connection location due to the tendency of the ramming tube to move away from a vertical line, generally in a forward direction.

Due to the bending torques on the vibrator and leader that result from the forward movement of the ramming tube, there is increased wear of the slide bars, which not only guide the vibrating exciter cell in the vibrator hood but also guide the carriage on which the vibrator is mounted on the leader.

Currently either the vibro replacement probe is attached directly using a hydraulic clamping apparatus arranged on the vibrator, or the vibro replacement probe is directly connected with the vibrator by way of a screw connection. In both cases, in order to set up the construction machine, the vibrator is attached to a carriage that can be moved along the leader of the construction machine. The vibro replacement probe is now mounted on the vibrator using a suitable sling, and the vibrator is moved upward on the leader until the vibro replacement probe assumes a vertical position. Subsequently the vibro replacement probe is connected with the vibrator by means of a clamping apparatus or by way of a screw connection.

This connection of the vibro replacement probe to the leader is very complicated and takes place at a significant height, and thus results in a significant hazard for the personnel.

SUMMARY OF THE INVENTION

Against this background, the invention seeks to provide a remedy. The invention is based on the task of making available a vibro replacement probe that makes it possible to set up a construction machine with minimized effort, while simultaneously reducing the hazard potential. These and other tasks are accomplished by means of a vibro replacement probe having the characteristics according to the invention.

With the invention, a vibro replacement probe is made available that makes it possible to set up a construction machine with minimized effort, while simultaneously reducing the hazard potential. The filling piece comprises a feed tube and a filling funnel and/or a hose connection flange. Because the feed tube is firmly connected with a vibrator that has means for a pivoting connection of the leader to a construction machine, horizontal placement of the vibro replacement probe close to the ground, with subsequent attachment to the leader, is made possible, and afterward the probe is moved upward and, during this process, can be pivoted into the vertical position by way of the pivoting attachment. Because the means comprise a connection part, which is connected with the vibrator so as to pivot and which can be attached to a carriage that is displaceably guided on the leader, attachment to a carriage that is displaceably guided on the leader is made possible. By means of an attachment that can pivot about a horizontal axis, it is made possible for the vibro replacement probe to perform a pendulum motion in the freely hanging state. The ramming tube is preferably firmly connected with the vibrator, in other words with the housing or the housings in which the imbalance masses rotate.

According to the invention, the vibrator and the ramming tube are firmly connected, for example screwed together by way of the feed tube of the filling piece. The clamping tongs that are usually used to attach the vibro replacement probe to the vibrator as the pile element are eliminated.

In a further development of the invention, the connection part is elastically connected with the vibrator, wherein the elastic connection is formed by rubber/metal rails and/or helical springs and/or elastomer elements. The connection part can comprise a connection plate or also a connection frame, which can be attached to the carriage.

In an embodiment of the invention, the connection part has hooks and/or receiving holes, which correspond to receiving holes and/or hooks arranged on the carriage of the leader. In this way, shape-fit attachment of the vibrator to the carriage, with minimized effort, is achieved.

Alternatively, the connection part itself can also be configured as a carriage, and provided with guides by way of which it can be displaceably attached to the leader directly. This alternative, however, has the disadvantage that this carriage would then have to be connected with the advancing cables of the leader, something that is complicated, in particular also because these advancing cables would first have to be released again when dismantling the construction machine.

In a further embodiment of the invention, the connection part is provided with a holding rack that is releasably attached to the connection part. In this way, secure, essentially horizontal holding of the vibro replacement probe for installation on a leader is made possible. Furthermore, transport protection of the vibro replacement probe is achieved. In the pivoted position of the connection part, the vibrator can be laid down on the holding rack.

In a further development of the invention, the holding rack is attached to the connection part by way of bolts and/or screws. In this way, easy removal of the holding rack after the vibro replacement probe has been attached to the leader of a construction machine is made possible.

In an embodiment of the invention, the holding rack has a support surface, in particular a U-shaped support surface, set at a right angle to the connection part. In this way, the holding rack can be used as a support foot for installation of the connection part to the leader. In the folded-in position of the connection part, holding of the vibrator by the holding rack, framing the part, is achieved due to the U-shaped configuration of the support surface.

In a further embodiment of the invention, the connection part has a projecting gibbet that is connected with the vibrator so as to pivot. In this way, a pivot axle at a distance from the connection part is made possible, by way of which axle the vibro replacement probe can be positioned parallel to the connection part.

In a further development of the invention, the filling piece comprises a filling funnel that is connected with the ramming tube by way of at least one spring element and/or by way of an elastic sealing element. In this way the material to be rammed in, for example gravel, is prevented from being jammed in and being crushed between the ramming tube and the funnel. This mechanism of damage regularly leads to significant wear. The funnel is uncoupled from the ramming tube and does not oscillate with it.

In an embodiment of the invention, the vibrator has a passage that aligns with the ramming tube. This passage has a cross-section that is greater than or equal to the cross-section of the ramming tube. In this way it is made possible to feed reinforcement elements into the ramming tube through the vibrator.

In a further embodiment of the invention, the filling piece comprises a filling funnel, and a tube piece is passed through the passage, which is connected with the ramming tube, wherein the tube piece has at least one lateral opening within the funnel. In this way, introduction of filling material from the side is made possible, while simultaneously allowing access to the ramming tube from above. In this regard, the funnel preferably encloses the tube piece, wherein it does not oscillate along with the tube piece, but rather is elastically mounted, wherein the gap between the funnel and the tube piece is closed off by means of a seal.

In a further development of the invention, the filling piece comprises a filling funnel, and the vibrator comprises two exciter cells that are firmly connected with the feed tube, wherein the exciter cells are connected with one another by way of a yoke. In this way, a straight-line passage in the direction of the axis of rotation of the ramming tube is achieved, for introduction of reinforcement elements or construction elements.

In an embodiment of the invention, the vibrator is configured to be self-synchronized, wherein the exciter cells are not compulsorily synchronized by way of a gear mechanism. In this regard, at least two individual imbalances rotate without being coupled by a gear mechanism. The imbalances are arranged next to one another, so that a vertical vibration occurs. Good prerequisites for self-synchronization exist as the result of a firm connection with the long, heavy, and rigid ramming tube.

As a person skilled in the art knows, certain conditions have to be met for self-synchronization of multiple imbalances. Under disadvantageous circumstances, self-synchronization does not function or does not function in a stable manner. In these cases, it is practical to couple the two exciter cells with a corresponding gear mechanism for compulsory synchronization. This gear mechanism may be, for example, a gear train or drive shafts. Whether or not this compulsory synchronization is necessary depends, for example, on the length of the vibro replacement probe and thereby on the construction site situation. In an alternative embodiment of the invention, a gear mechanism is therefore releasably connected with the exciter cells, by way of which mechanism the exciter cells are compulsorily synchronized. It is advantageous if the gear mechanism is structured as a synchronization module that can be screwed onto the two exciter cells if necessary.

Furthermore, a construction machine having a leader on which a carriage is displaceably guided, on which carriage a vibro replacement probe of the aforementioned type is attached so as to pivot, is an object of the present invention.

The invention is furthermore based on the task of making available a method for equipping a leader of a construction machine with a vibro replacement probe, which method makes it possible to set up the construction machine with minimized effort, while simultaneously reducing the hazard potential.

This task is accomplished by means of a method having the characteristics according to the invention. Because the leader is at first oriented vertically, the vibro replacement probe is positioned essentially horizontally, and the vibrator of the vibro replacement probe is attached to a carriage guided on the leader, so as to pivot, and afterward the carriage is moved upward along the leader, until the ramming tube of the vibro replacement probe is situated in a vertical position above the ground, all of the set-up work can be performed close to the ground.

In a further development of the invention, the connection part of the vibro replacement probe has fastening means that interact, with shape fit and/or force fit, with fastening means arranged on the carriage of the leader, wherein the connection part that is connected with the vibrator, so as to pivot, is oriented vertically, so that it stands on the holding rack, and the connection part is connected with the carriage. Subsequently, the carriage is first moved upward along the leader so that the holding rack no longer contacts the ground, and afterward the holding rack is removed from the connection part. Subsequently, the carriage is moved further upward, until the ramming tube of the vibro replacement probe is situated in a vertical position above the ground. In this way, setting up the leader of the construction machine, with minimized effort, is achieved.

Preferably the construction machine is moved horizontally, during the upward movement of the carriage, in such a manner that the tip of the ramming tube performs the smallest possible translational movement relative to the ground.

The movement of the construction machine is of particular importance during dismantling. During dismantling of the vibro replacement probe, it is at first situated in a vertical position. For disassembly, the carriage must be moved downward on the leader, while at the same time, the construction machine must be moved backward. It is important that the construction machine moves at least so quickly that the tip of the ramming tube, which rests on the ground, is not pushed forward, in other words away from the construction machine.

The required movement speed of the construction machine can be calculated, during set-up, from the length (which must be indicated) of the ramming tube and the carriage speed. During dismantling, the probe length results from the carriage position, so that the required movement speed can be calculated from the carriage position and the carriage speed. Advantageously, a computer and control unit is present, in which an algorithm for calculating the movement speed from the carriage speed is stored in memory, and which unit is set up for automatically carrying out a movement of the construction machine during movement of the carriage, for set-up or dismantling.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1A:
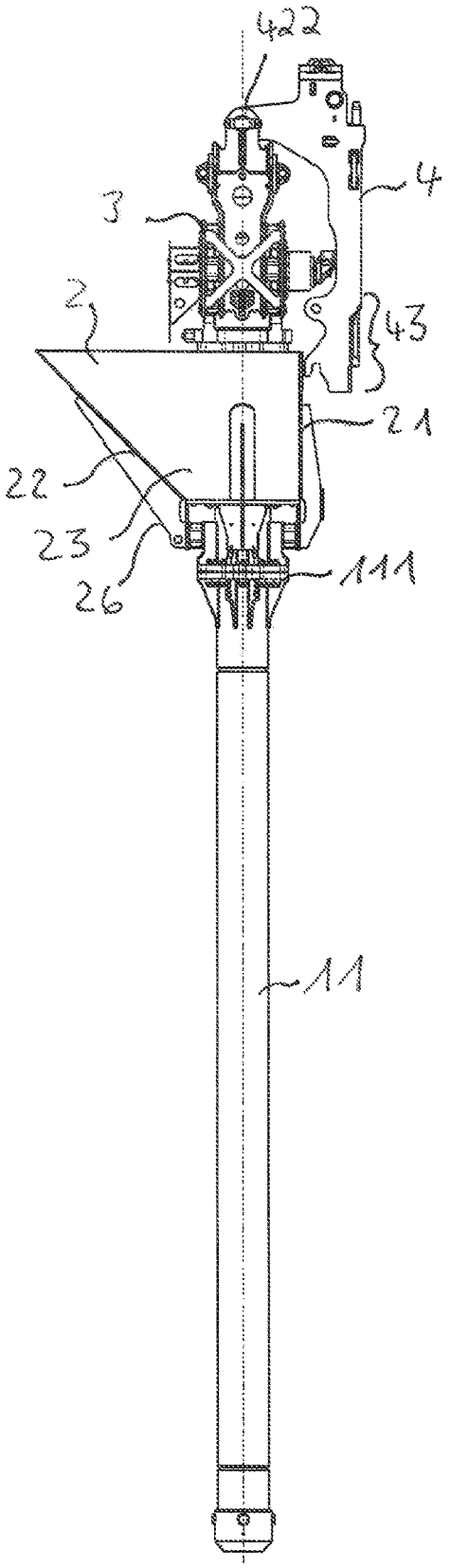
FIG. 1A shows a side view of a vibro replacement probe.
Figure 1B:
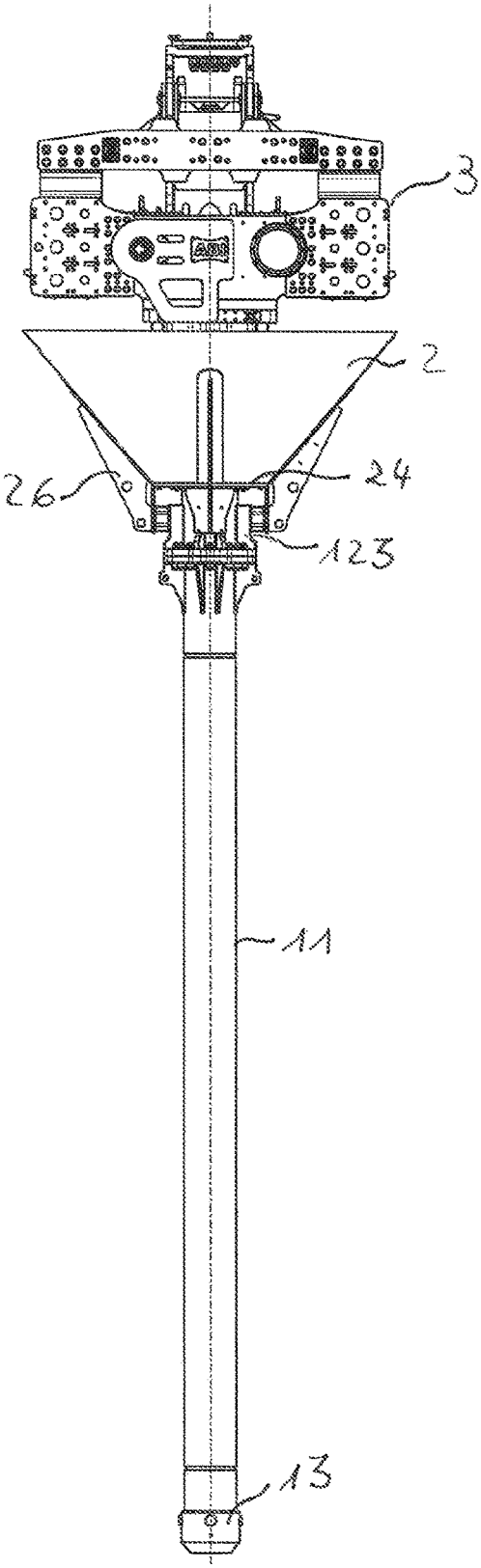
FIG. 1B shows a front view of the vibro replacement probe from FIG. 1A.
Figure 1C:
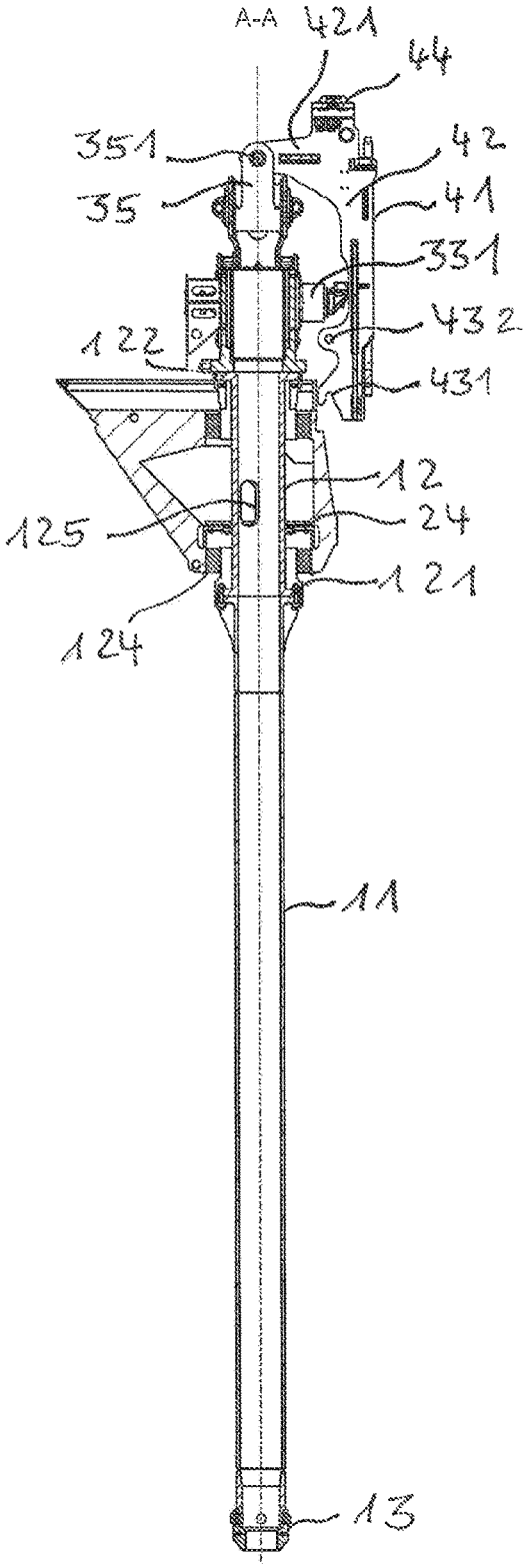
FIG. 1C shows the side view of FIG. 1A in longitudinal section.
Figure 1D:
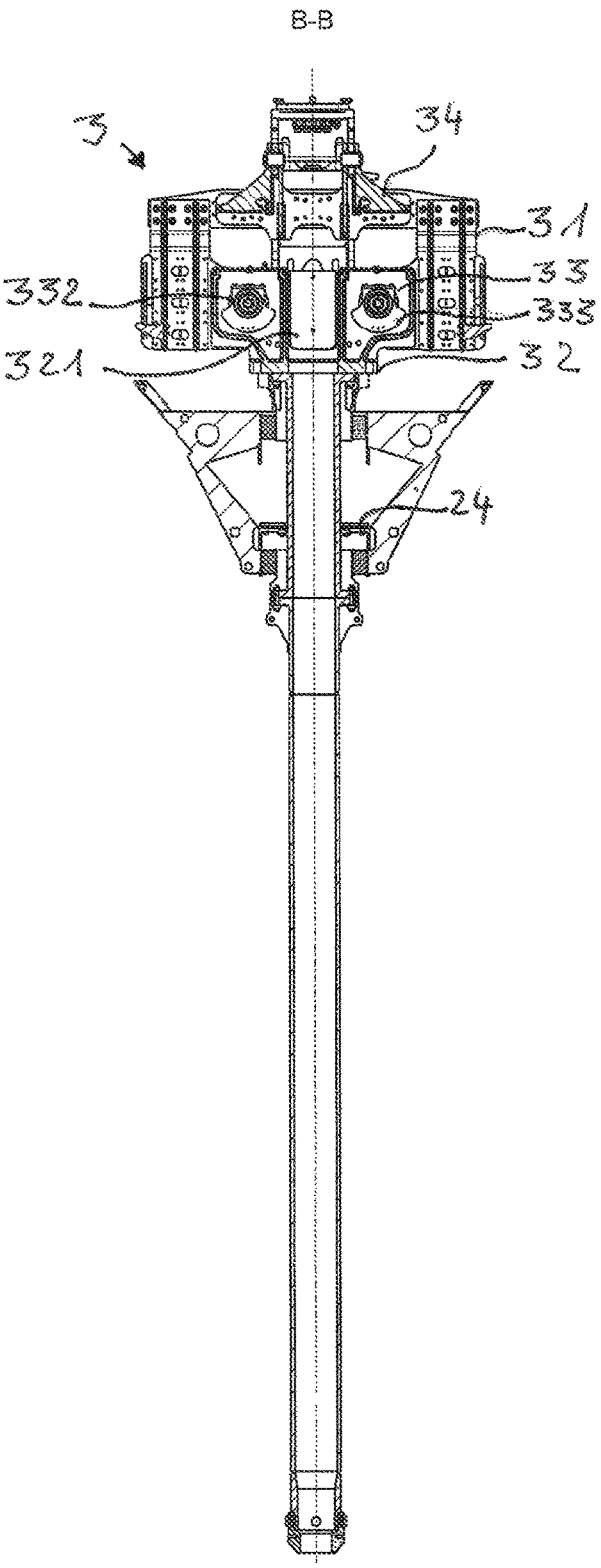
FIG. 1D shows the front view of FIG. 1B in longitudinal section.
Figure 1E:
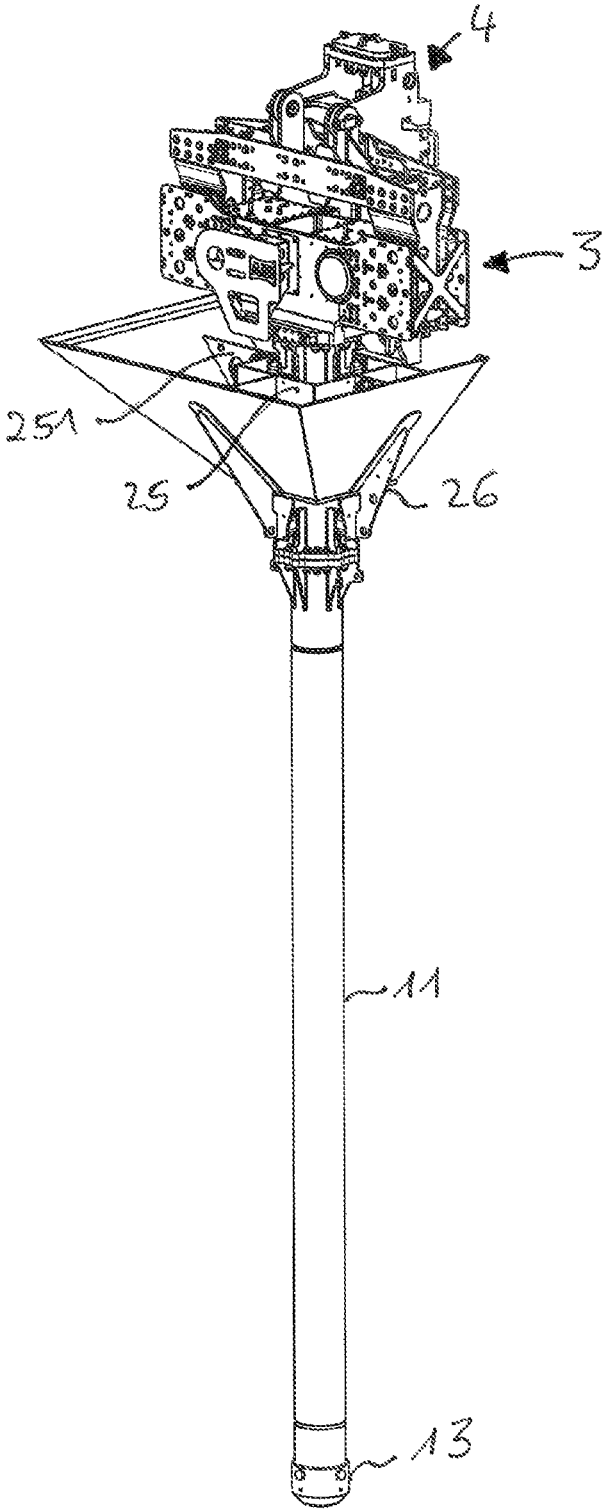
FIG. 1E shows a spatial representation of the vibro replacement probe from FIG. 1A.

The vibro replacement probe selected as an exemplary embodiment comprises a tube that passes through a funnel 2, with which it is connected and on which a vibrator 3 is attached on the end side, on which vibrator a connection part 4 is attached so as to pivot.

The tube is formed essentially by a ramming tube 11 that is connected with a feed tube 12 and is provided, on its end that lies opposite the feed tube 12, with a tip 13 that is configured in the manner of a sleeve that narrows conically on its end side, which tip is set onto the ramming tube 11 and screwed onto it.

The feed tube 12 has a circumferential flange 121, 122 at its two ends, in each instance. The two flanges 121, 122 lie against four ribs 123, in each instance, which run axially and are arranged circumferentially on the feed tube 12, offset from one another by 90°, in each instance. A first flange 121 of the feed tube 12 is screwed onto a flange 111 that is present on the ramming tube 11 on the end side, so that the feed tube 12 is connected with the ramming tube 11 so as to be aligned with it.

The funnel 2 comprises a rear wall 21 that runs parallel to the feed tube 12, an inflow wall 22 that is set at a distance from the rear wall and set at an outward angle relative to it, as well as two side walls 23, which are set parallel to one another and connect the rear wall 21 and the inflow wall 22 on both sides, and jointly delimit an essentially rectangular passage into which a bottom plate 24 is set, through which plate the feed tube 12 is passed. On the inside, a support ring 25 having an essentially rectangular cross-section is arranged in the funnel 2, which ring is connected with the rear wall 21, inflow wall 22, and side walls 23 by way of four struts 251 that are set offset from one another by 90°, in each instance. On the outside, the funnel 2 is provided with a support plate 26 on each rear wall 21, side wall 23, and inflow wall 22. The feed tube 12 is connected with the funnel 2 by way of springs 124. The springs 124 are arranged between the ribs 123 that border on the first flange 121 and the support plates 26, on the one side, and between the ribs 123 that border on the second flange 122 and the support ring 25, on the other side. In the exemplary embodiment, the springs 124 are formed by SCHWINGMETALL or helical springs. Within the funnel 2, two openings 125 that penetrate the tube wall are introduced into the feed tube 12, lying diametrically opposite one another. The openings 125 serve for entry of filling material applied to the funnel 2 into the ramming pipe 11.

An elastic seal 241 is arranged between the oscillating feed tube 12 and the funnel 2, which is connected with the former by way of springs 124, which seal closes off the gap between the bottom plate 24 of the funnel 2 and the feed tube 12. This seal 241 must be structured to be wide enough so as to be able to equalize the vertical displacement path between feed tube 12 and funnel 2 without damage. This displacement path results from the static displacement of the funnel 2 as the result of its own weight and its load, as well as from the oscillating movement of the feed tube 12. In the exemplary embodiment, the seal 241 consists of rubber. Alternatively, it can also be produced from an elastomer plastic.

The vibrator 3 comprises a housing 31, having a bottom-side flange 32, which is screwed onto the second flange 122 of the feed tube 12. A pipe socket 321 that projects into the housing 31 is formed on the flange 32, aligning with the feed tube 12. The housing 31 contains two exciter cells 33 that are arranged opposite one another, between which the pipe socket 321 runs, and which have in each instance a shaft 332 connected with a hydraulic motor 331, in each instance, on which shaft an imbalance mass 333 is arranged. On the top side of the housing 31, which lies opposite the flange 32, a yoke 34 is arranged, onto which two pairs of holding plates 35 are welded, parallel to and at a distance from one another, which plates are provided with bores 351, in each instance, wherein the bores 351 of the two pairs of holding plates 35 align with one another.

The connection part 4 comprises a connection plate 41 that is configured to be essentially rectangular, on the longitudinal sides of which side plates 42 are arranged, which are connected with one another on the top side of the connection part 4, by way of a head plate 44. The side plates 42, on the top of the connection part 4, in each instance, have an arm 421 that projects out approximately orthogonal to the connection plate 41 and forms a gibbet, into which arm a bore 422 is introduced, wherein the bores 422 of the arms 421, which are arranged parallel to one another, align with one another. On the side of each side plate 42 that lies opposite the arm 421, this plate furthermore has a hook 431 and a holding motion link 43 arranged at a distance from the hook, which motion link has a bore 432 for holding a holding rack 5.

The connection part 4 is connected with the yoke 34 of the housing 31 of the vibrator 3, so as to pivot, wherein the arms 421 are positioned between the holding plates 35 of a pair of holding plates, in each instance, in such a manner that the bores 422 of the arms 421 align with the bores 351 of the holding plates 35, wherein a bolt 45 is passed through the bores 351, 422 of the holding plates 35 and of the arms 421, which bolt functions as a pivot axle.

The holding rack 5 consists essentially of a frame 51 configured in C shape, which has two holding arms arranged parallel to one another and set orthogonal to the frame at the transitions between the center crosspiece and the shanks. The holding arms are provided with a bore 521, in each instance, at their free end. An axle holder 522 is arranged at a distance from the two bores 521 of the two holding arms, which bores align with one another, through which bores an axle—not shown—is passed, by way of which the two holding arms are connected with one another. Furthermore, two foot pieces 53 that project outward are arranged on the frame 51, which pieces each continue a shank 511 and extend over a region of a holding arm.

For assembly of the holding rack 5, the axle—not shown—is introduced into the hooks 431 of the holding motion links 43 of the connection part 4. Subsequently the holding rack 5 is pivoted about the axle—not shown—until the bores 521 of the holding arms align with the bores 432 of the holding motion links 43. The holding arms are then connected with the side plates 42 of the connection part 4 by way of bolts that are passed through the bores 521, 432.

Figure 2A:
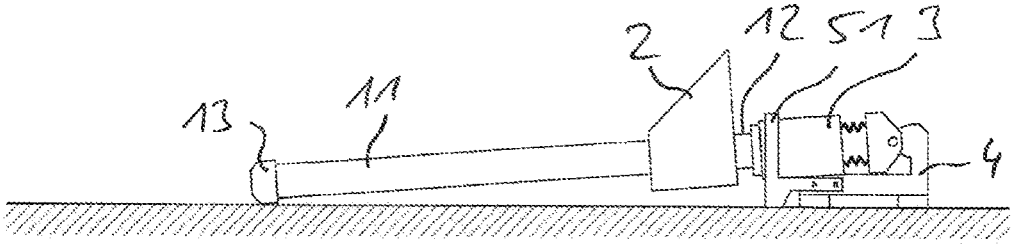
FIG. 2A shows a set-up process of the leader of a construction machine having a vibro replacement probe, with the vibro replacement probe in the transport position.
Figure 2B:
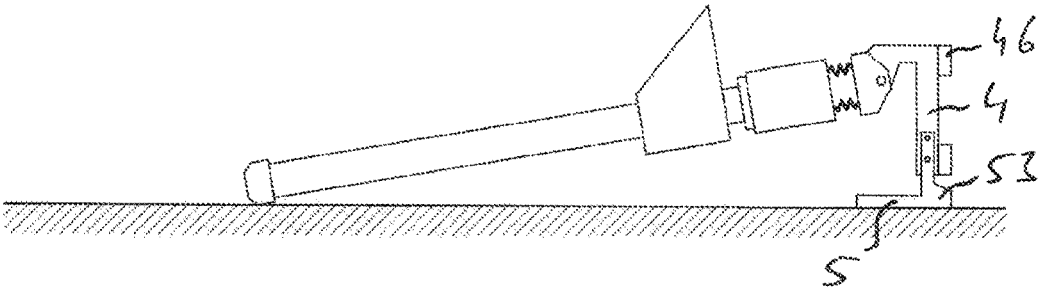
FIG. 2B shows the set-up process of the leader of a construction machine having a vibro replacement probe, with the vibro replacement tube with connection part in the raised position.
Figure 2C:
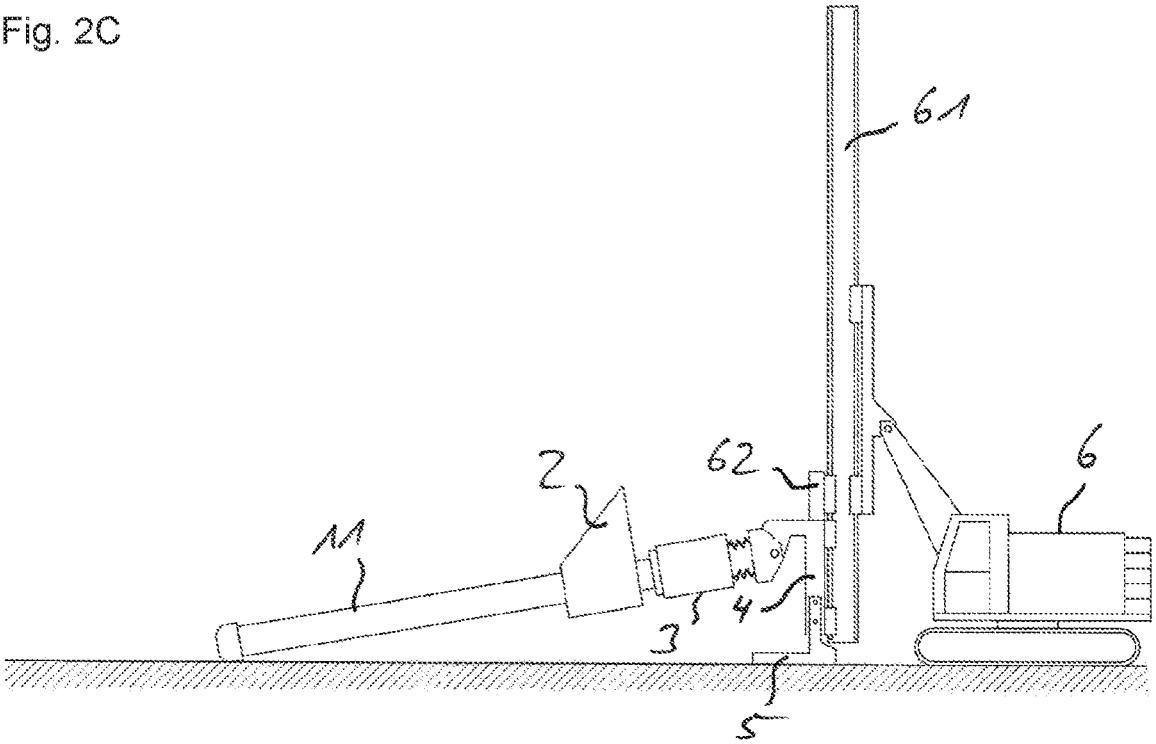
FIG. 2C shows the set-up process of the leader of a construction machine having a vibro replacement probe, with attachment of the connection part to the leader.
Figure 2D:
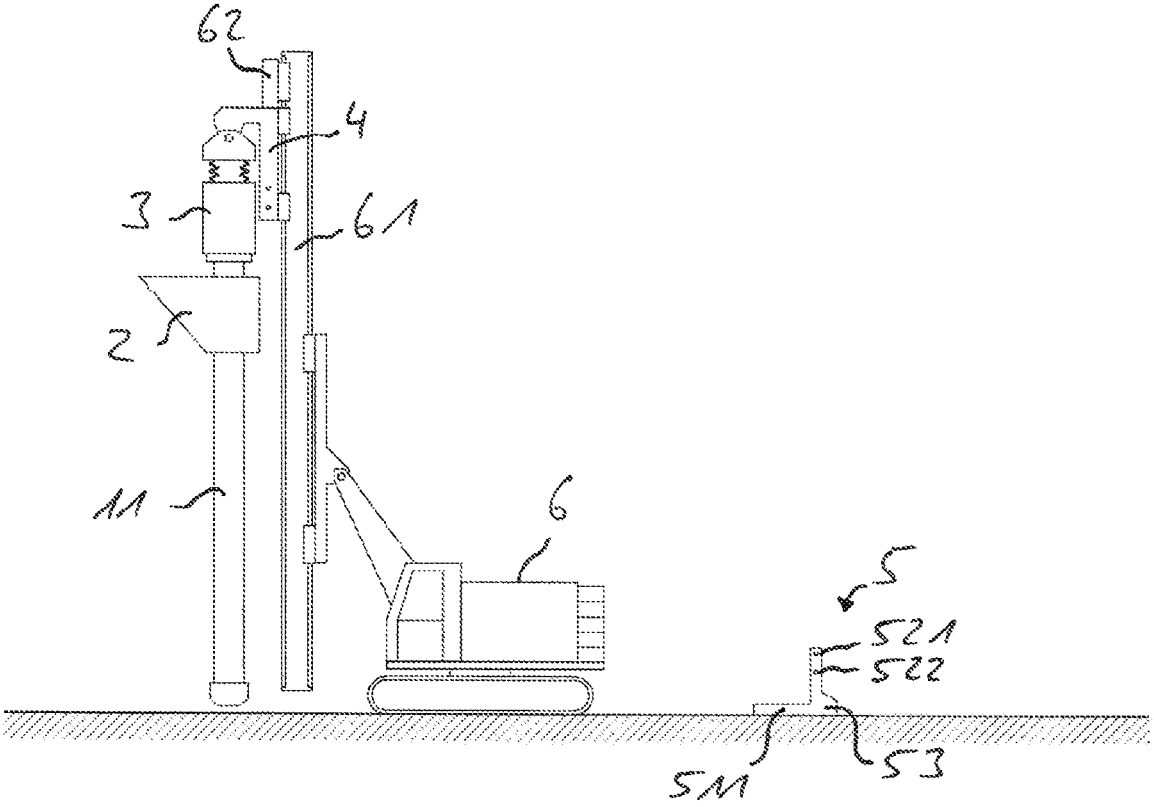
FIG. 2D shows the set-up process of the leader of a construction machine having a vibro replacement probe, with the vibro replacement tube in the working position.
Figure 3:
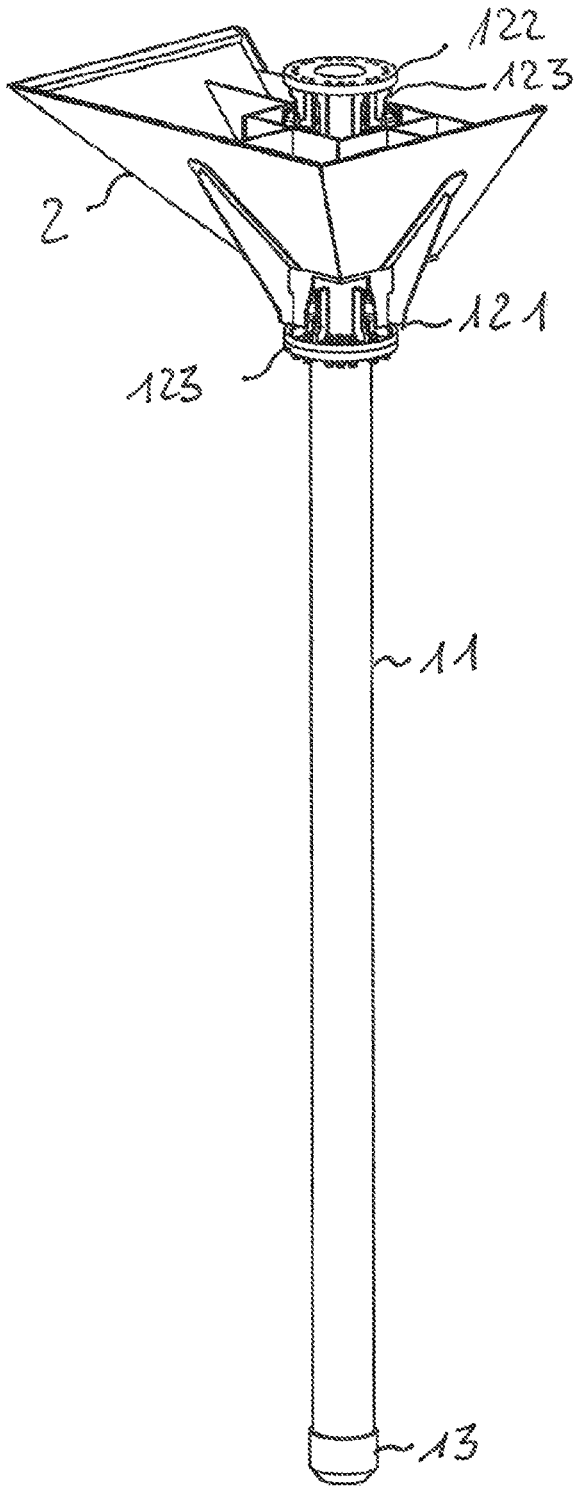
FIG. 3 shows a spatial representation of the vibro replacement probe from FIGS. 1A-1E (without vibrator)

To set up the leader 61 of a construction machine 6, the vibro replacement probe is first positioned in the transport position (FIG. 2A). Subsequently the connection part 4, with the holding rack 5 attached to it, is pivoted in such a manner that the connection part 4 stands on the holding rack 5, which is functioning as a support foot in this position (FIG. 2B). Subsequently the leader 61 of the construction machine 6, which is set vertically, is set against the vertically positioned connection part 4, which is then connected with the carriage 62 of the leader 61. The carriage 62, with the connection part 4, is moved along the leader 61 until the holding rack 5 is suspended freely. Subsequently the holding rack 5 is removed from the connection part 4, after the bolts that have been passed through the bores 521 have been removed, and the carriage 62 is moved upward until the ramming tube 11 of the vibro replacement probe has reached its vertical working position.

Figure 4:
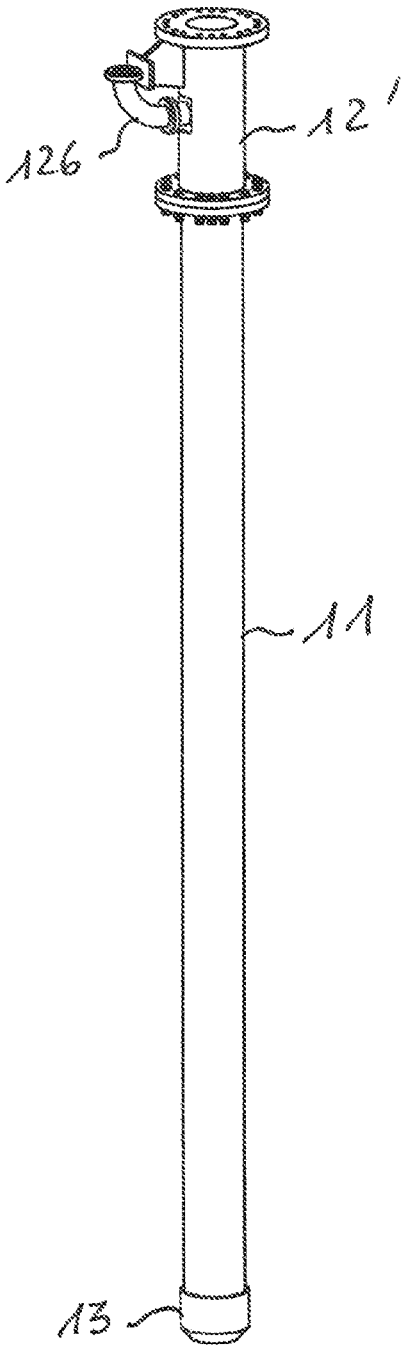
FIG. 4 shows a spatial representation of a vibro replacement probe in a further embodiment (without vibrator)
Figure 5A:
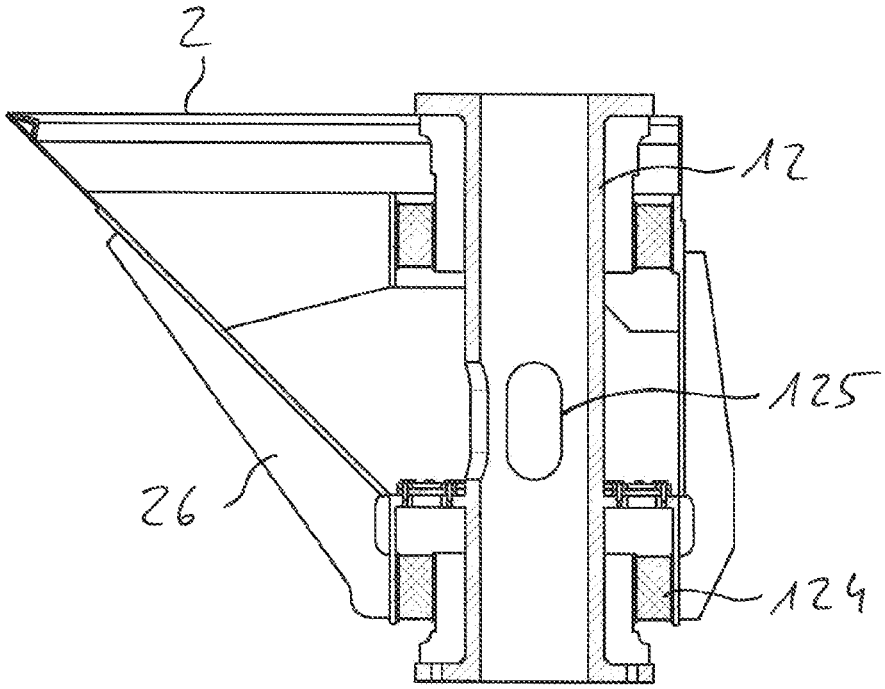
FIG. 5A is a longitudinal sectional representation of the connection of funnel and feed tube of the vibro replacement probe from FIGS. 1A-1E.
Figure 5B:
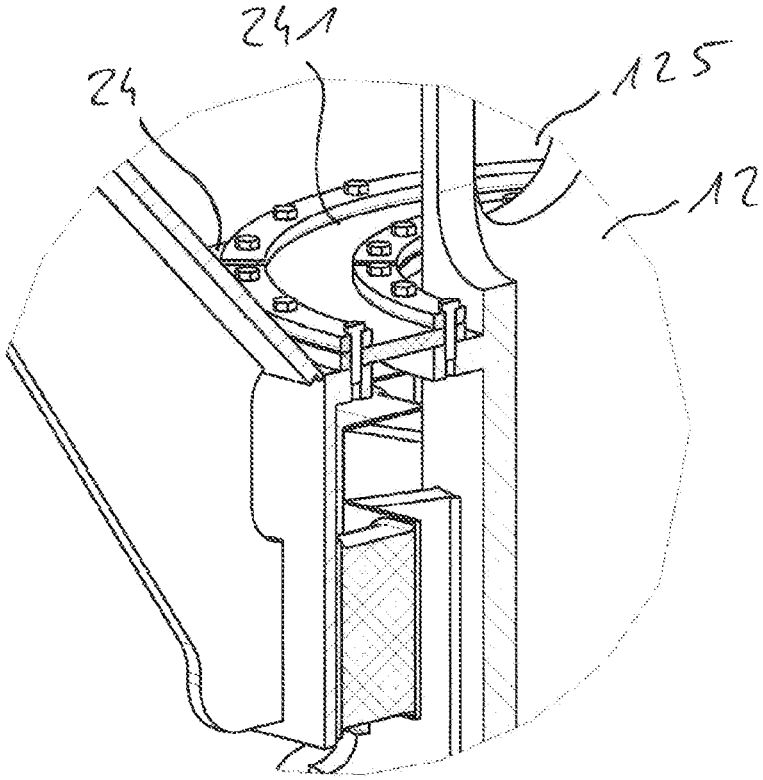
FIG. 5B is a detail representation of the seal on the ground side of the connection of funnel and feed tube of the vibro replacement probe from FIGS. 1A-1E.

An alternative embodiment of a vibro replacement probe without a vibrator is shown in FIG. 4. Here the feed tube 12' is provided with a pipe socket 126 for connecting a line for concrete—not shown.

Figure 6:
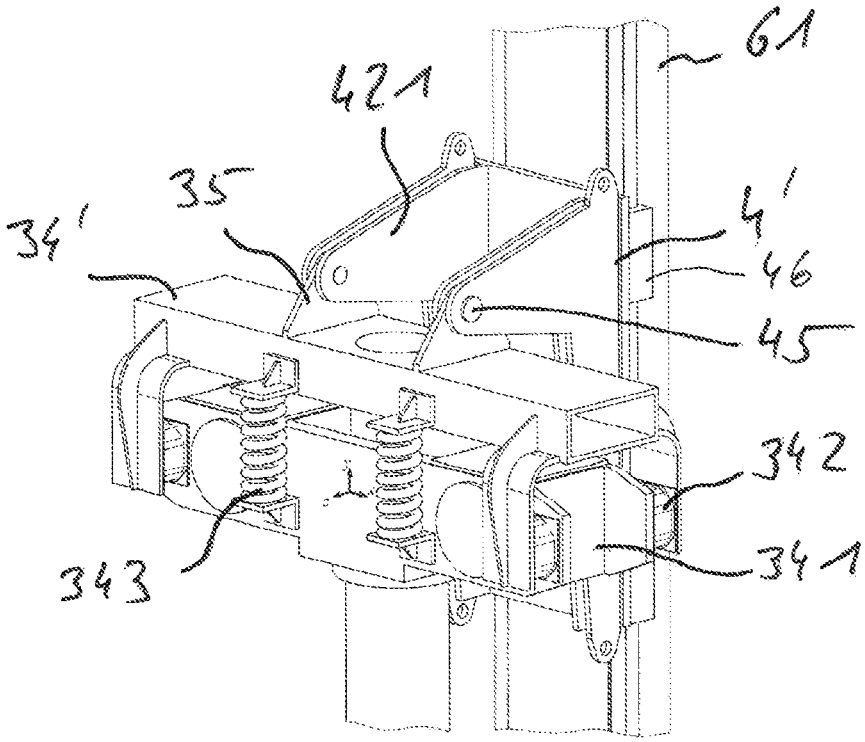
FIG. 6 shows the articulation connection of the connection part and vibrator of a vibro replacement probe.
Figure 7:
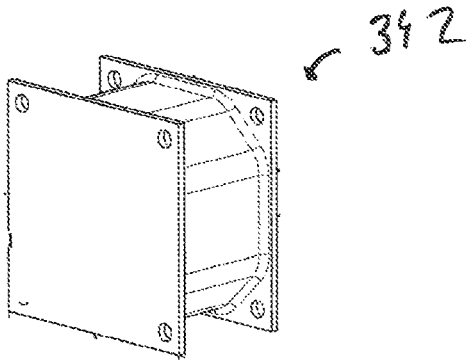
FIG. 7 shows a SCHWINGMETALL or rubber/metal rail of the articulated connection from FIG. 6.

An alternative embodiment of the yoke 34' is shown in FIG. 6. The yoke 34' accommodates an oscillation housing 341, in which SCHWINGMETALL or rubber/metal rails 342 are arranged at a distance from one another. The SCHWINGMETALL or rubber/metal rails 342 absorb forces both in horizontal directions and in the vertical direction. On the outside, two helical springs 343 are arranged on the oscillation housing, at a distance from one another, which springs are connected with the yoke 34' and essentially absorb forces in the vertical direction. Instead of the helical springs 343, crane buffers can also be provided. In this exemplary embodiment, the connection part 4' is configured as a carriage, into the guides 46 of which the leader 61 is moved. After attachment of the advancing cables—not shown—to the connection part 4' configured as a carriage, this part can be moved along the leader.

Although only a few embodiments of the present invention have been shown and described, it is to be understood that many changes and modifications may be made thereunto without departing from the spirit and scope of the invention.

What is claimed is:

1. A vibro replacement probe configured to attach to a carriage displaceably guided on a leader of a construction machine, the vibro replacement probe comprising:

(a) a filling piece comprising a feed tube and at least one of a filling funnel and a hose connection flange;

(b) a ramming tube connected with the filling piece;

(c) a vibrator connected with the feed tube; and (d) a connection part pivotably connected directly with the vibrator and configured to attach to the carriage displaceably guided on the leader of the construction machine.

2. The vibro replacement probe according to claim 1, wherein the connection part is elastically connected with the vibrator; and wherein the elastic connection is formed by way of at least one of rubber/metal rails, helical springs, and elastomer elements.

3. The vibro replacement probe according to claim 1, wherein the connection part comprises a connection plate or a connection frame.

4. The vibro replacement probe according to claim 1, wherein the connection part has at least one of hooks and receiving holes configured to correspond to receiving holes or hooks arranged on the carriage of the leader.

5. The vibro replacement probe according to claim 1, further comprising a holding rack releasably attached to the connection part.

6. The vibro replacement probe according to claim 5, wherein the holding rack is attached to the connection part by way of at least one of bolts and screws.

7. The vibro replacement probe according to claim 6, wherein the holding rack has a support surface set at a right angle to the connection part.

8. The vibro replacement probe according to claim 7, wherein the support surface is U-shaped.

9. The vibro replacement probe according to claim 1, wherein the filling piece comprises the filling funnel and the filling funnel is connected with the ramming tube by way of at least one spring element, by way of an elastic sealing element, or by way of at least one spring element and an elastic sealing element.

10. The vibro replacement probe according to claim 1, wherein the filling piece comprises the filling funnel and the vibrator comprises first and second exciter cells connected with the feed tube; and wherein the exciter cells are connected with one another by way of a yoke.

11. The vibro replacement probe according to claim 10, wherein the first and second exciter cells are structured to be self-synchronizing.

12. The vibro replacement probe according to claim 10, wherein the vibrator has a passage that aligns with the ramming tube; and wherein the passage has a cross-section that is greater than or equal to a cross-section of the ramming tube.

13. The vibro replacement probe according to claim 12, wherein the feed tube is passed through the passage and is connected with the ramming tube; and wherein the feed tube has at least one lateral opening within the filling funnel.

14. A construction machine having a leader and a carriage displaceably guided on the leader, wherein the vibro replacement probe according to claim 1 is attached to the carriage so as to pivot.

15. A method for setting up a leader of a construction machine, the method comprising:

(a) providing the construction machine with a vibro replacement probe comprising a filling piece comprising a feed tube and at least one of a filling funnel and a hose connection flange; a ramming tube connected with the filling piece; a vibrator connected with the feed tube; and a connection part pivotably connected with the vibrator and configured to attach to a carriage displaceably guided on the leader of the construction machine;

(b) first orienting the leader vertically, positioning the vibro replacement probe horizontally, and attaching the vibrator of the vibro replacement probe to the carriage guided on the leader so as to pivot; and (c) subsequently moving the carriage upward along the leader until the ramming tube of the vibro replacement probe is situated in a vertical position above the ground.

16. A method for setting up a leader of a construction machine, the method comprising:

(a) providing the construction machine with a vibro replacement probe comprising a filling piece comprising a feed tube and at least one of a filling funnel and a hose connection flange; a ramming tube connected with the filling piece; a vibrator connected with the feed tube; a connection part pivotably connected with the vibrator and configured to attach to a carriage displaceably guided on the leader of the construction machine; and a holding rack releasably attached to the connection part by way of at least one of bolts and screws;

(b) first orienting the leader vertically, positioning the vibro replacement probe horizontally, and attaching the vibrator of the vibro replacement probe to the carriage guided on the leader so as to pivot, wherein the connection part that is connected with the vibrator so as to pivot is connected to the carriage and is oriented vertically; and (c) subsequently moving the carriage upward along the leader initially so far that the holding rack no longer has any contact with the ground;

(d) removing the holding rack from the connection part; and (e) subsequently moving the carriage further upward until the ramming tube of the vibro replacement probe is situated in a vertical position above the ground.

* * * * *